United States Patent [19]

Weigel et al.

[11] Patent Number: 4,940,223

[45] Date of Patent: Jul. 10, 1990

[54] APPARATUS FOR RECEIVING AND ORDERLY STORING INDIVIDUAL SHEETS IN A CONTAINER

[75] Inventors: Peter Weigel, Paderborn Dorenhagen; Guenter Holland-Letz, Paderborn-Elsen, both of Fed. Rep. of Germany

[73] Assignee: Nixdorf Computer AG, Paderborn, Fed. Rep. of Germany

[21] Appl. No.: 314,968

[22] Filed: Feb. 24, 1989

[30] Foreign Application Priority Data

Mar. 15, 1988 [DE] Fed. Rep. of Germany ..... 3808624

[51] Int. Cl.[5] ..... B65H 29/40

[52] U.S. Cl. ..... 271/181; 271/189; 271/315

[58] Field of Search ..... 271/181, 180, 187, 315, 271/189

[56] References Cited

U.S. PATENT DOCUMENTS 1,991,411 2/1935 Novick ..... 271/181
4,474,365 10/1984 Di Blasio ..... 271/187 X
4,512,263 4/1985 Lanning ..... 271/181 X
4,678,072 7/1987 Kobayashi ..... 271/181 X

*Primary Examiner*—Richard A. Schacher

[57] ABSTRACT

In an apparatus for receiving generally rectangular individual sheets and for storing the same in a container (14) in orderly condition, which container is arranged in a housing and has a throughput opening (34) connected with an input opening of the housing by a transport belt (18) for serially transporting the individual sheets, the throughput opening in at least the direction of one edge of the sheets is smaller than the corresponding measurement of the sheets. At the end of the transport belt (18, 24) a stacking apparatus (22) is arranged in front of the throughput opening and includes a stack support surface (30) for forming a stack of sheets, the sheets being arranged upright on the stack support surface (30) and parallel to the throughput opening (34). For inserting the sheets in the container (14) a pusher (48) is provided which is shiftable in the direction toward throughput opening. By means of this pusher the sheet stack formed on the stack support surface (30) is pushable into the throughput opening of the container (14) with accompanying bending of the sheet stack.

12 Claims, 3 Drawing Sheets

APPARATUS FOR RECEIVING AND ORDERLY STORING INDIVIDUAL SHEETS IN A CONTAINER

Figure 1:
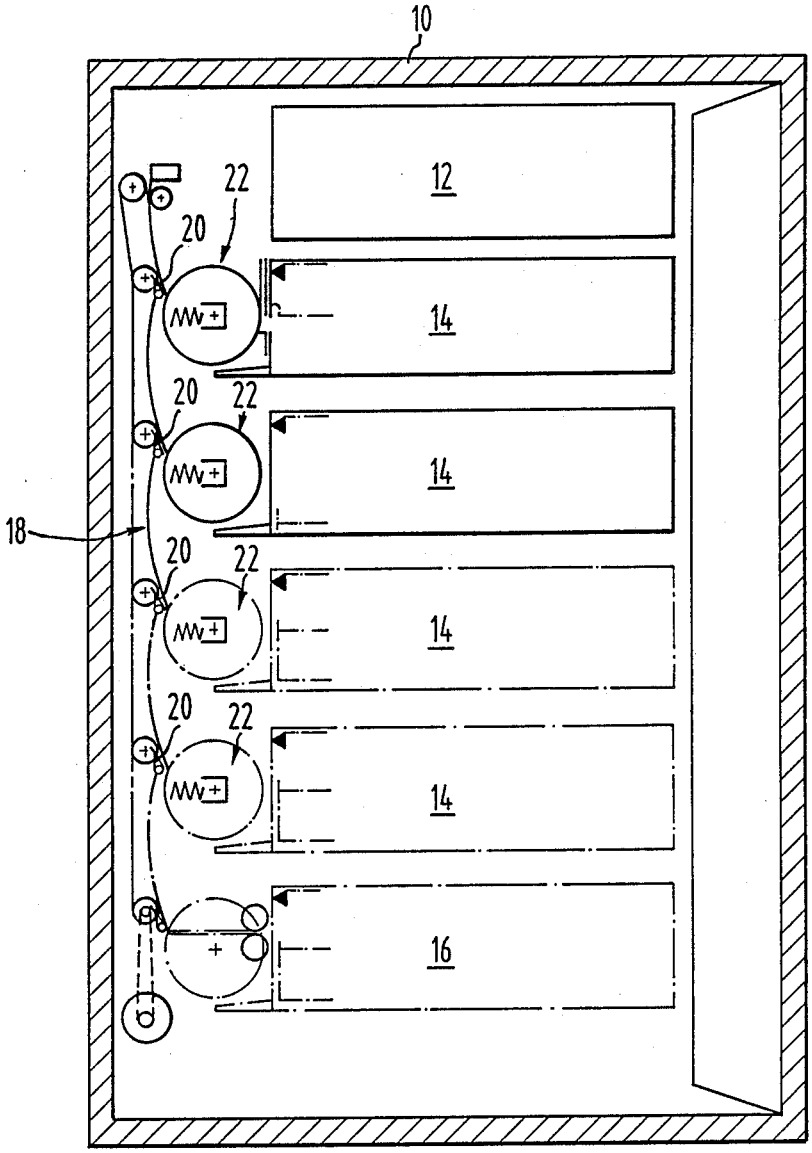

This invention relates to a device for receiving generally rectangular individual sheets, especially bank notes, and for orderly storing the same in a container arranged in a housing and having a throughput opening, which throughput opening of the container is connected with the input opening of the housing through a transport belt for serially transporting the individual sheets.

The invention has as its object the provision of an apparatus of the aforementioned type by means of which it is possible to store the sheets so neatly and orderly in the container that this container without further processing can be put into a device for automatically separating and dispensing the sheets.

This object is solved in accordance with the invention in that the throughput opening of the container at least in the direction of one of the edges of the sheets is smaller than the corresponding measurement of the sheets, that at the end of the transport belt is a stacking aPParatus in front of the throughPut oPening With a stack supporting surface for forming a stack of sheets, in that the sheets stand upright on the stacking surface and parallel to the throughput opening, and that a pusher shiftable in the direction toWard the throughput opening is provided with which the sheet stack formed on the stackinq surface can be pushed into the throughput opening of the container with accompanying bending of the sheet stack.

The sheets are therefore, in accordance With the invention, not inserted into the container sheet by sheet. In that case it is hardly possible to insert; sheets which arrive at greater speed into the container so as to form a neat stack. If sufficient play is provided in order to insert the sheets individually into the container this means that the sheets can fall over or shift position. If insufficient play is provided then the sheets do not slide through to the container bottom but instead stay hanging to one another and do not allow themselves to be ordered. In contrast to this, in the solution of the invention a stack is first formed on the stack support surface in front of the container which allows the sheets to be ordered. The ordered stack is then pushed by a pusher into the opening which is too small for the stack so that the stack is bent in at least one direction. Behind the throughPut oPening the sheet stack relaxes again Whereupon the sheets stand rigid and in an arranged stack in the container.

For use of the same container in a sheet dispensing apparatus it is advantageous if the throughput opening is not smaller than the size of the sheets. In order to not have to change the container it is therefore advantageous if one of the edges bordering the throughput opening and parallel to the bending axis of the sheet stack is connected With the stack support surface. At the same time, this edge can serve as a bearing surface for the stack to be formed on the stack support surface. In order to adjust the device to different heights of sheets it is practical if the stack support surface together with this edge is arranged to be adjustable in height.

Preferably the stacking apparatus includes two known stacking Wheels axially spaced from one another and between which the pusher is arranged. The pusher is, in the preferred embodiment, made as a pressure plate shiftable by a linkage. This linkage for the saving of space can be folded together so that even in the case of a large stroke of the Pusher only a small space is required for the pusher shifting mechanism.

In order to neatly arrange the sheets of the stack not only in the height direction but also in the side direction, in accordance with the invention, arranging elements are provided on both sides of the stack support surface for imposing a definite arrangement on the side surfaces of the stack. These can be formed as roll shaped elements each of Which is rotatable oppositely relative to the other about an axis perpendicular to the sheets standing on the stack support surface, with the rotational direction preferably being so chosen that the sheets are pressed toward the stack support surface. These arranging elements have the effect that the sheets are pushed entirely into the stack and are so arranged that their side edges form a unitary stack surface. The roll shaped elements can have an outer surface made of an elastic material, for example an open celled foam material. In a preferred embodiment the arranging elements are made as bristle rolls.

Figure 2:
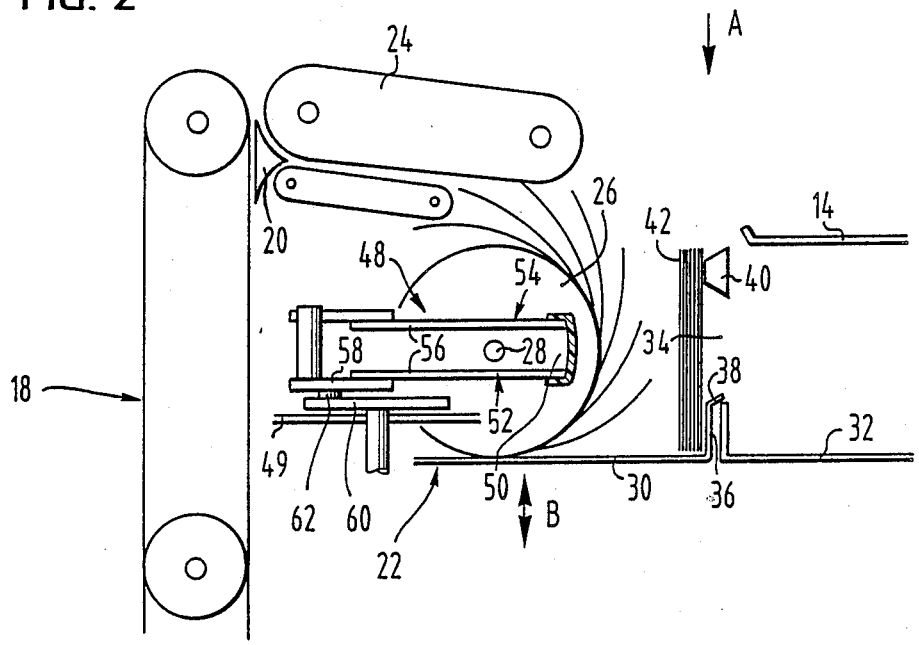
Figure 4:
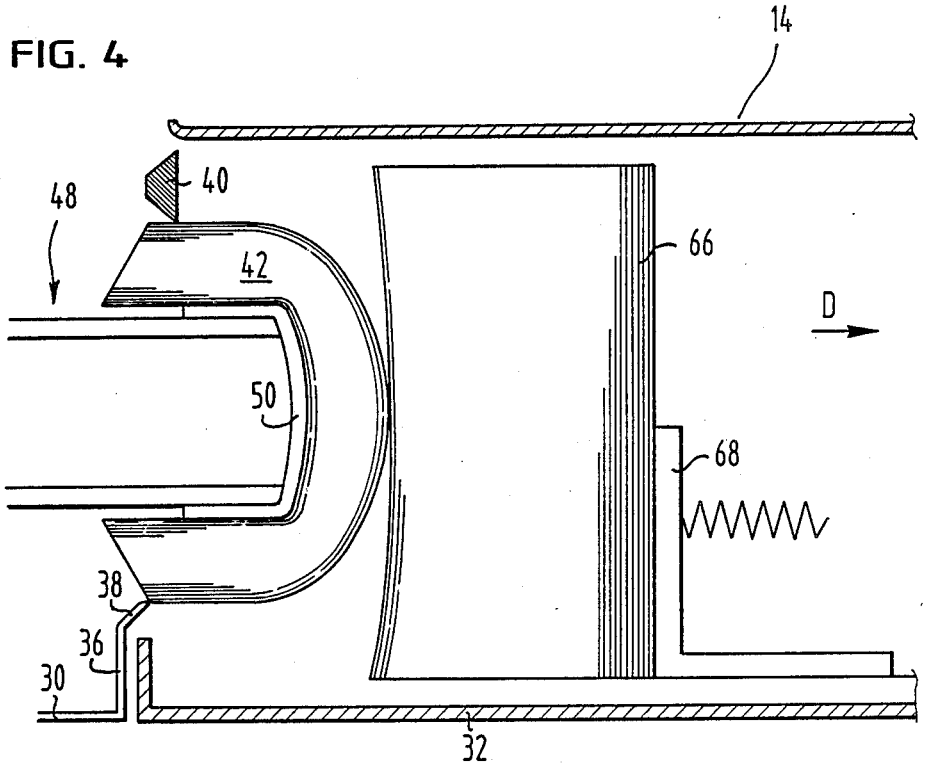
Figure 3:
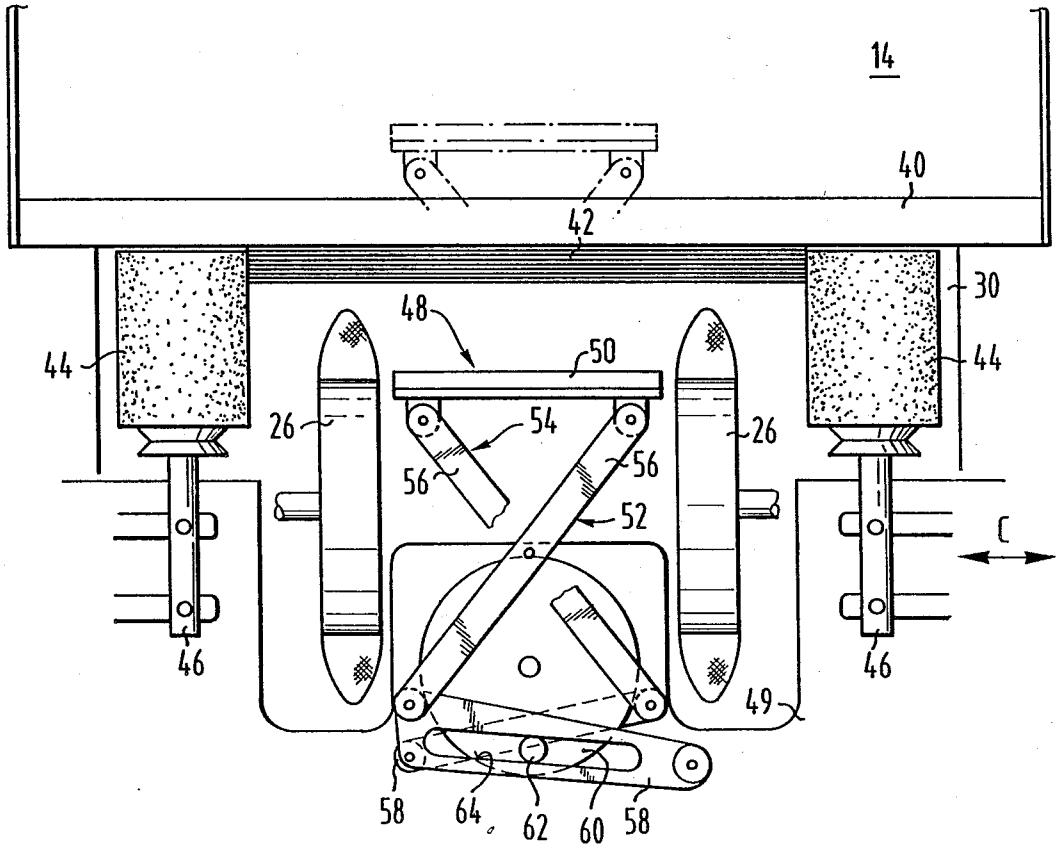

In order that the sheet stack can be pushed by the pusher far enough into the container to allow a relaxing of the stack and Without allowing the already stacked sheets inside the container to fall doWn, the invention provides that a pressure plate engaging the sheet stack inside of the container is moveable in unison with the movement with the pusher. This movement can take place through a drive device, or also the pressure plate can be adjusted against spring force by the pusher Which pushes the sheets into the container. Further features and advantages of the invention will be apparent from the following description, which in connection With the accompanying drawings explains the invention in connection With an exemplary embodiment. The figures show:

FIG. 1, a schematical vertical section through an automaton for receiving bank notes, FIG. 2, a schematic side vieW in enlarged scale of the input station for bank notes in a bank note holder, FIG. 3, a partially schematic plan view of the arrangement of FIG. 2 in the direction of the arrow A, and FIG. 4, a schematic view of the inner space of the holder during the insertion into the holder of a bank note packet. The vault of a bank note input automaton is indicated at 10 in FIG. 1. This vault encloses a verification unit 12 for the bank notes as well as a number of cassettes 14 in which the bank notes found acceptable by the verification unit !0 can be stored. Below the bank note cassettes !4 is a cassette 16 in which those bank notes are stored which for various reasons are not to be given out again and which are therefore not stored in the bank note cassettes 14. A transport belt indicated generally at 18 serve to transport the bank notes from the verification unit 12 to the cassettes 14 and 16. From this belt bank notes are delivered by means of deflectors 20 to storing mechanisms 22 associated with each cassette 14, which storing mechanisms will noW be explained in detail in connection With FIGS. 2 and 3.

FIG. 2 shows a fragment of the transport belt 18 With a deflector 20 and a sheet conveyor 24 which delivers the bank notes arriving over the deflector 20 to two stacking wheels 26, which stacking wheels are rotatably supported (see also FIG. 3) for rotation about an axis 28 perpendicular to the plane of the drawing in axially spaced relationship to one another. The frame Parts in Which the shaft of the stacking wheels 26 is rotatably supported are not illustrated. The stacking wheels 26 extend into recesses in a stacking platform 30 arranged parallel to the bottom 32 of the cassette 14. At its end facing the input opening 34 of the cassette 14 the platform has a raised edge 36 Which terminates in an inclined surface 38 directed toward the throughput opening 34. The stacking platform of 30 is adjustable in height in the direction of the double arrow B in a non-illustrated way. The upper edge of the throughput opening 34 is bounded by a bar 40 which is part of the cassette 14. Through a height adjustment of the stacking platform 30, the height dimension of the throughput opening 34 can be so adjusted that it is smaller than the width of the bank notes 42 to be input as measured in the same direction.

Two rolls 44 made of foam material or bristles are rotatably supported on shafts 46 perpendicular to the front side of the cassette 14 With the rolls being located axially outboard of the stacking wheels 26 and above the stacking platform 30. The shafts 46 are adjustable relative to a frame Part 49 in the direction of the double arrow C so that the spacing between the opposite sides of the two rolls can be set to the width of the bank notes 42 to be stacked on the stacking platform 30. The rolls 44 have the purpose of wiping against the side edges of the bank notes 42 to align these in the side wisedirection, and for doing this the rolls 44 can also be eccentrically supported or vibratively driven in order to push the bank notes 42 on the stacking platform 30 toward one another in the sidewise direction. Preferably the rolls 44 turn in opposite directions so that the bank notes 42 are pressed against the stacking platform 30. The drive of the rolls can take place in a desired way, and can for example be derived from the drive for the stacking wheels through a non-illustrated belt drive.

Between the stacking Wheels 26 is a pusher, indicated generally at 48, which is shiftable perpendicularly to the forward side of the cassette 14. This pusher consists of a pressure plate 50 which with the help of two toggle linkages indicated generally at 52 and 54, is shiftable between a first position shown in FIG. 3 by the solid lines and a second position shown by the broken lines. The toggle linkages 52, 54 each consists of tWo levers 56, 58 Which at their one ends are pivotally connected with one another and at their free ends are on one hand pivotally connected to the pressure plate 50 and on the other hand pivotally connected to the frame part 49. The shifting of the toggle linkages takes place with the help of a crank disk 60 carrying a pin 62 received in a slot 64 in the lever 58. If the crank disc is turned clockwise from the position illustrated in FIG. 3 the lever 58 is likewise pivoted in the clockwise direction, so that the Pressure Plate 50 is moved in the direction toward the throughput opening 34 of the cassette 14. By reverse rotation of the crank disc 60, the pressure plate 50 is again withdrawn.

If during the movement of the pressure plate 50 in the direction toward the cassette 14 a stack of notes is located on the stacking platform, this stack Will be pressed through the throughput opening 34. During this the stack bends around the pressure plate 50 since the edge 36 on one hand and the bar 40 on the other hand hold back the edges of the notes. At the same time, as a result of this, the stack 66 already contained in the cassette 14 is pushed in the direction of the arroW D along With the pressure plate 68 engaging the stack 66. When the pusher 48 has pushed the bank note packet so far into the container 14 that the bent edges of the bank note packet or stack can again relax, the pressure plate 68 through spring force pushes the entire stack 66 opposite to the direction of the arroW D towards the throughput opening 34 at which the stack is held by the upper and lower cassette edges.

We claim:

1. An apparatus for receiving generally rectangular individual sheets, especially bank notes, and for storing them in ordered condition in a container, which container is arranged in a housing and has a throughout opening connected with an input opening of the housing through a transport belt for the serial transport of the individual sheets, characterized in that said throughput opening of said container at least in the direction of one edge of said sheets is smaller than the corresponding measurement of said sheets, that at the end of said transport belt and in front of said throughput opening a stacking apparatus is arranged with a stack support surface extending perpendicularly to said throughput opening for forming a stack of sheets so that said sheets of said stack stand upright on said stack support surface and parallel to said throughput opening, and that a pusher is provided which is shiftable in the direction toward said throughput opening, by means of which pusher a sheet stack formed on said stack support surface can be pushed into said container through said throughput opening with accompanying bending of said sheet stack.

2. An apparatus according to claim 1, further characterized in that an edge bordering said throughput opening and parallel to the bending axis of said sheet stack is connected with said stack support surface.

3. An apparatus according to claim 1, further characterized in that said stack support surface is adjustable in height.

4. An apparatus according to claim 1, further characterized in that said stacking apparatus includes stacking wheels axially spaced from one another and between which said pusher is arranged.

5. An apparatus according to claim 1, further characterized in that said pusher comprises a pressure plate shiftable by a linkage.

6. An apparatus according to claim 1, further characterized in that arranging elements are located on both sides of said stack support surface for arranging the side surfaces of the stack.

7. An apparatus according to claim 1, further characterized in that a pressure plate engaged with a sheet stack inside said container is shiftable in unison with the movement of said pusher.

8. An apparatus according to claim 7, further characterized in that said pressure plate is shiftable by a drive apparatus.

9. An apparatus according to claim 7, further characterized in that said pressure plate is shiftable against spring force by said pusher which pushes said stack of sheets into said container.

10. An apparatus for receiving generally rectangular individual sheets, especially bank notes, and for storing them in ordered condition in a container, which container is arranged in a housing and has a throughput opening connected with an input opening of the housing through a transport belt for the serial transport of the individual sheets, characterized in that the throughput opening of the container at least in the direction of one edge of the sheets is smaller than the corresponding measurement of the sheets, that at the end of the transport belt and in front of the throughput opening a stacking apparatus is arranged with a stack support surface for forming a stack of sheets, that the sheets stand upright on the stack support surface and parallel to the throughput opening, and that a pusher is provided which is shiftable in the direction toward the throughout opening, by means of which pusher the sheet stack formed on the stack support surface can be pushed into the container through the throughput opening with accompanying bending of the sheet stack, said arranging elements being located on both sides of said stack support surface for arranging the side surfaces of the stack, and said arranging elements being formed as roll elements rotatable in opposite directions about axes perpendicular to the forward side of said container.

11. An apparatus according to claim 10, further characterized in that said arranging elements are formed as rolls each with a soft elastic outer surface.

12. An apparatus according to claim 10, further characterized in that said arranging elements are formed as bristle rolls.

* * * * *

UNITED STATES PATENT AND TRADEMARK OFFICE

CERTIFICATE OF CORRECTION

PATENT NO. : 4,940,223

DATED : July 10, 1990

INVENTOR(S) : Weigel et al.

It is certified that error appears in the above-identified patent and that said Letters Patent is hereby corrected as shown below:

Column 1

Line 24, delete "aPParatus" and substitute--apparatus--
Line 24, delete "throughPut oPening With" and substitute--throughput opening with--.
Line 28, delete "toWard" and substitute--toward--.
Line 33, delete "With" and substitute--with--.
Line 49, delete "throughPut oPening" and substitute--throughput opening--.
Line 50, delete "Whereupon" and substitute--whereupon-
Line 58, delete "With" and substitute--with--.
Line 65, delete "Wheels" and substitute--wheels--.

Column 2

Line 2, delete "Pusher" and substitute--pusher--
Line 10, delete "Which" and substitute--which--.
Line 24, delete "Without" and substitute--without--
Line 25, delete "doWn" and substitute--down--.
Line 31, delete "Which" and substitute--which--.
Line 34, delete "With" and substitute--with--.
Line 35, delete "With" and substitute--with--.
Line 39, delete "vieW" and substitute--view--.
Line 46, begin new paragraph at "The vault of a bank'
Line 59, delete "noW" and substitute--now--.
Line 60, delete "With" and substitute--with--.
Line 61, delete "With" and substitute--with--.
Line 67, delete "Parts" and substitute--parts--.
Line 68, delete "Which" and substitute--which--.

UNITED STATES PATENT AND TRADEMARK OFFICE

CERTIFICATE OF CORRECTION

PATENT NO. : 4,940,223

DATED : July 10, 1990

INVENTOR(S) : Weigel et al.

It is certified that error appears in the above-identified patent and that said Letters Patent is hereby corrected as shown below:

Column 3

Line 5, delete "Which" and substitute--which--.
Line 18, delete "With" and substitute--with--.
Line 21, delete "Part" and substitute--part--.

Line 36, delete "Wheels" and substitute--wheels--.
Line 43, delete "tWo" and substitute--two--.
Line 44, delete "Which" and substitute--which--.
Line 53, delete "Pressure Plate" and substitute--pressure plate--.
Line 59, delete "Will" and substitute--will--.
Line 65, delete "arroW" and substitute--arrow--.
Line 66, delete "With" and substitute--with--.

UNITED STATES PATENT AND TRADEMARK OFFICE

CERTIFICATE OF CORRECTION

PATENT NO. : 4,940,223

DATED : July 10, 1990

INVENTOR(S) : Weigel, et al

It is certified that error appears in the above-identified patent and that said Letters Patent is hereby corrected as shown below:

Column 4

Line 3, delete "arroW" and substitute--arrow--.
Line 10, delete "throughout" and substitute--throughput--.

Column 5

Lines 5 and 6, delete "throughout" and substitute--throughput--.

Signed and Sealed this

Ninth Day of March, 1993

*Attest:*

STEPHEN G. KUNIN

*Attesting Officer*

*Acting Commissioner of Patents and Trademarks*